US008514668B1

(12) United States Patent
Labadie

(10) Patent No.: US 8,514,668 B1
(45) Date of Patent: Aug. 20, 2013

(54) CHRISTMAS THEMED MECHANICAL CLOCK

(76) Inventor: Robert F. Labadie, Nashville, TN (US)

( * ) Notice: Subject to any disclaimer, the term of this patent is extended or adjusted under 35 U.S.C. 154(b) by 36 days.

(21) Appl. No.: 13/347,480

(22) Filed: Jan. 10, 2012

Related U.S. Application Data

(60) Provisional application No. 61/431,181, filed on Jan. 10, 2011.

(51) Int. Cl.
*G04B 25/06* (2006.01)

(52) U.S. Cl.
USPC ..... 368/77; 368/229

(58) Field of Classification Search
USPC ..... 368/243, 45, 229, 244, 77; D10/8
See application file for complete search history.

(56) References Cited

U.S. PATENT DOCUMENTS 218,945 A * 8/1879 Dittmeier ..... 368/222
1,534,901 A * 4/1925 Bonthoux ..... 368/243
3,419,989 A * 1/1969 Booty ..... 40/728
4,993,006 A * 2/1991 Oshima et al. ..... 368/231
5,438,154 A * 8/1995 Segan et al. ..... 84/600
6,210,250 B1 * 4/2001 Sui ..... 446/358
6,361,325 B1 * 3/2002 McGuire ..... 434/304
6,614,727 B2 * 9/2003 McGuire ..... 368/223
7,477,574 B2 * 1/2009 Takiguchi ..... 368/75
D671,844 S * 12/2012 Wright ..... D10/8

* cited by examiner

*Primary Examiner* — Sean Kayes
(74) *Attorney, Agent, or Firm* — Waddey & Patterson, P.C.; Gary L. Montle

(57) ABSTRACT

A Christmas-themed mechanical clock includes a base with first and second substantially planar platforms spaced apart from and in parallel with each other, with the second platform further having first and second grooves defined therein. At least one gear drive is positioned between the first and second platforms. A first nativity character assembly is coupled to one gear drive and driven between first and second positions along the first groove for a first predetermined period of time. A second nativity character assembly is coupled to another gear drive and driven between first and second positions along the second groove for a second predetermined period of time. A twenty-four hour background clock assembly coupled to the second platform, at least a portion of which rotates in accordance with first and second twelve hour time periods to display first and second background images, respectively.

1 Claim, 9 Drawing Sheets

CHRISTMAS THEMED MECHANICAL CLOCK

CROSS-REFERENCES TO RELATED APPLICATIONS

This application claims benefit of the following patent application(s) which is/are hereby incorporated by reference: U.S. Provisional Application No. 61/431,181 filed on Jan. 10, 2011.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to a mechanical clock having a plurality of accessories arranged to move in concert with associated time increments. More particularly, this invention relates to a Christmas-themed clock having a plurality of groups of characters or elements independently associated with gear drives of varying proportions to move according to the various stages of advent, and equivalents thereof.

Mechanical clocks have been in existence for many years, generally providing one or more sets of display figures that appear and move along predetermined paths upon a trigger, usually upon the hour or some other predetermined and periodic rate. In some cases, the figures may also perform a routine in the process of moving about the clock, but generally these figures move from a starting position within the clock housing along a path which makes them visible from outside the housing and back to the starting position until the next periodic trigger. Further, these triggers and associated routines are generally presumed to occur periodically throughout the year, or are otherwise manually triggered or turned off entirely.

Clocks which have display themes in accordance with a particular season or event such as for example Christmas are also known, but generally consist of either a static display in the context of a clock, or a mechanical clock performing a set routine at periodic intervals such as described above, and which may be turned off and stored when Christmas has come and gone.

What is not currently known in the art is a themed mechanical clock that includes display figures which move about the clock, not merely in a set routine at periodic intervals, but throughout the entirety of the predetermined season. The Christmas season is a particular example where such a clock would be a poignant novelty item, as the entire season in accordance with the Christian religion is a build-up throughout advent to the moment of the birth of Christ, although other events, holidays or seasons such as for example Easter or those which are associated with other cultures or religions would find such an item useful and appropriate as well.

BRIEF SUMMARY OF THE INVENTION

In accordance with various aspects of the present invention, a mechanical clock is provided with a plurality of visual elements arranged to move along defined tracks and about a base. In a particular aspect, the mechanical clock has a Christmas theme, with the visual elements designed in accordance with a nativity scene and arranged to move about the clock in accordance with the Christmas season, more particularly advent and the epiphany.

In an embodiment of the present invention, the base having a first substantially planar platform and a second substantially planar platform spaced apart from and positioned in parallel with the first platform, the second platform further comprising first and second grooves. At least one gear drive is positioned between the first and second platforms. A first nativity character assembly (e.g., a display representing the Holy Family) is coupled to one of the at least one gear drives and driven between first and second positions along the first groove for a first predetermined period of time (e.g., for the duration of the advent season and ending on Christmas day). A second nativity character assembly (e.g., a display representing the three Kings) is coupled to one of the at least one gear drives and driven between first and second positions along the second groove for a second predetermined period of time (e.g., for the duration of the advent season and continuing to the epiphany). A twenty-four hour background clock assembly is coupled to the second platform, at least a portion of which is effective to rotate in accordance with first and second twelve hour time periods to display first and second background images, respectively (e.g., night and day).

In another aspect of the present invention, a third nativity character assembly (e.g., a display representing the baby Jesus) may be coupled to the second platform and spring-loaded to move from a first position between the first and second platforms to a second position above the second platform, and thereby visible from the outside of the clock, by one or both of the first and second character assemblies as they arrive at a predetermined point along the paths or grooves, such as for example on Christmas morning.

In accordance with certain embodiments of the present invention, a clock face may be coupled to the second platform and effective to display a current time of day in a conventional manner on a twelve hour scale.

In accordance with certain embodiments of the present invention, the gear drives may be either mechanically or electrically actuated within the scope of the present invention. Rather than using gears at all, in various embodiments an electronic control (one example being a stepper motor or the equivalent) may be implemented to drive the rotating disk for moving the various character assemblies along predetermined paths associated with the clock.

DETAILED DESCRIPTION OF THE INVENTION

Figure 1:
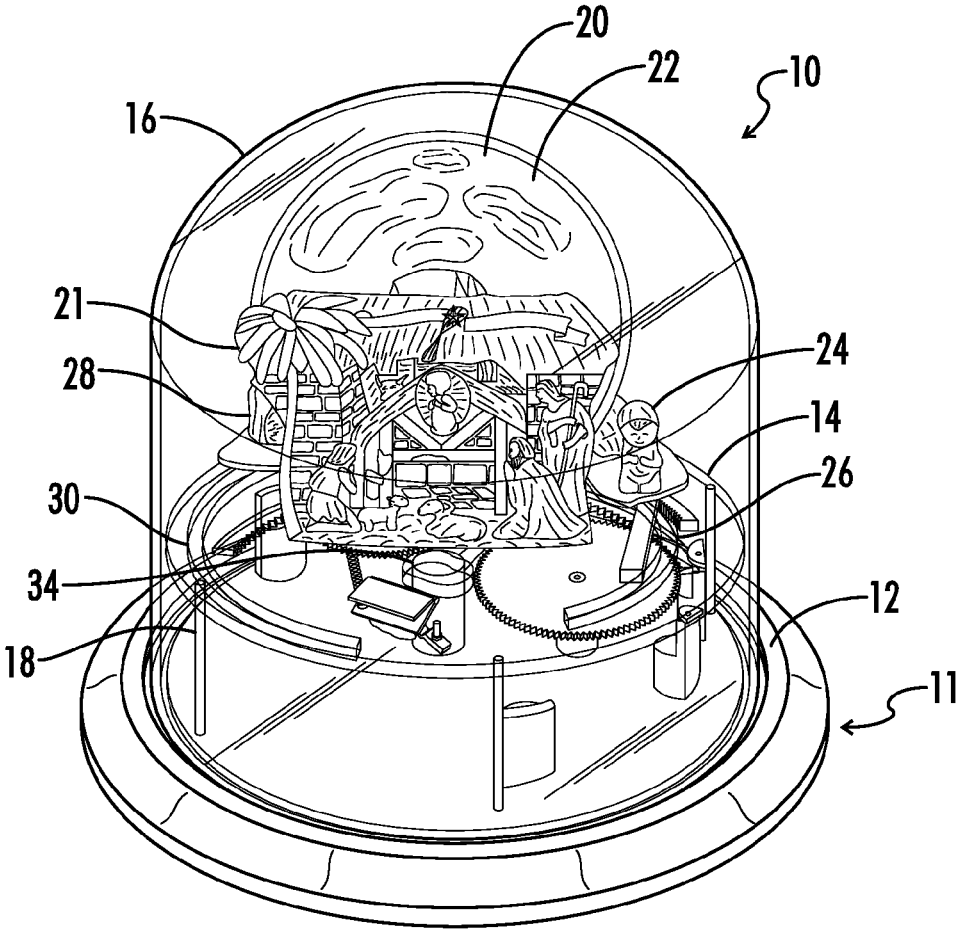
FIG. 1 is a front view of an embodiment of a mechanical clock in accordance with the present invention, in a fully assembled state.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct connection between recited items or an indirect connection through one or more passive or active intermediary devices. "Coupled" may further unless otherwise stated herein mean either of a temporary connection such as may be obtained for example through the use of a general adhesive, a semi-permanent connection such as may be provided for example through the use of a mechanical fastener, or a permanent connection such as may be obtained for example by welding or soldering of the recited items together.

Referring generally to FIGS. 1-13, various embodiments may be described herein for a Christmas-themed mechanical clock having display assemblies arranged to move about the clock in accordance with predetermined time durations associated with the Christmas season. Where the various figures may describe embodiments sharing various common elements and features with other embodiments, similar elements and features are given the same reference numerals and redundant description thereof may be omitted below.

Referring first to FIG. 1, in an embodiment of the present invention a mechanical clock assembly 10 includes a base 11 having a first substantially planar platform (first tier) 12 and a second substantially planar platform (second tier) 14 spaced from and substantially in parallel with the first tier 12. The first tier 12 as shown may be arranged to support the remainder of the clock 10 when positioned horizontally on or otherwise with respect to a flat surface.

In alternative embodiments the first and second tiers 12, 14 may be coupled to a third platform (not shown) which is arranged to support the remainder of the clock when positioned vertically against for example a wall, with the first and second tiers 12, 14 extending outward from the third platform and substantially parallel to the ground.

In an embodiment as shown the first and second tiers 12, 14 may be spaced apart using a plurality of individual spacers 18 or equivalent members having approximately the same length and arranged about the circumference of a first surface of the first tier 12. Alternatively, the first and second tiers 12, 14 may be spaced apart by a single spacer extending continuously about the first and second tiers 12, 14 and defining an interior which is removed from view from outside of the clock assembly 10.

Also included in the embodiment shown in FIG. 1 are first and second display assemblies 24, 28, a gear assembly (34, not shown in this figure) and a background clock assembly 20. An aperture 34 is provided in the second tier 14 through which a third display assembly (32, not shown in this figure) may be positioned for viewing or removed from view. In the embodiment shown, the display assemblies 24, 28, 32 have a common theme forming first, second and third nativity character assemblies 24, 28, 32 (namely, the Holy Family 24, the three Kings 28 and the baby Jesus 32), but in alternative embodiments the various assemblies may take different forms, and the present invention is not limited to the displayed number of display assemblies but may take on a variety of different forms within the scope of the present invention.

The first nativity character assembly 24 is coupled to the gear assembly 34 and driven by a gear drive associated with the gear assembly between first and second positions along a first groove 26 through the second tier 14 for a first predetermined period of time. The second nativity character assembly 28 is also coupled to the gear assembly and driven by a gear drive associated with the gear assembly between first and second positions along a second groove for a second predetermined period of time. The gear assembly 34 may generally have more than one gear drive such that the first and second display assemblies 24, 28 are coupled to dedicated gear drives having varying ratios, but alternative embodiments with a single gear drive are further within the scope of the present invention.

In alternative embodiments, rather than providing a gear assembly to drive the nativity character assemblies, one of skill in the art may appreciate that a non-gear driven system such as for example a magnetic system controlled by a microprocessor or other equivalent mechanisms may be used within the scope of the present invention. For example, in various embodiments an electronic control (one example being a stepper motor or the equivalent) may be implemented to drive the rotating disk for moving the various character assemblies along predetermined paths associated with the clock.

The twenty-four hour background clock assembly 20 is coupled to the second platform 14 as shown, with a first display portion 21 being generally static and a second display portion 22 which may be rotated or otherwise re-positioned in accordance with first and second twelve hour time periods to display first and second background images 22*a*, 22*b*, respectively. The background assembly 20 further may include a light source (not shown in this figure) which illuminates the display features from behind. The second display portion 22 may be driven continuously with the passage of time or may be arranged to spring from a first position displaying the first background image 22*a* in its entirety to an inverse second position displaying the second background image 22*b* in its entirety at for example twelve hour intervals.

In an embodiment as shown in FIG. 1, the clock assembly 10 may be provided with a cover 16 such as for example a substantially transparent dome which may be positioned over the remainder of the clock elements. A groove may in an embodiment be provided in the first surface of the first tier 12 and shaped to correspond with for example a threaded surface about the edge of the cover 16 whereby the cover may be fastened and unfastened to the first tier 12, but various alternative and equivalent mechanisms for the same are anticipated within the scope of the present invention and would be well known to a person of skill in the art.

Figure 2:
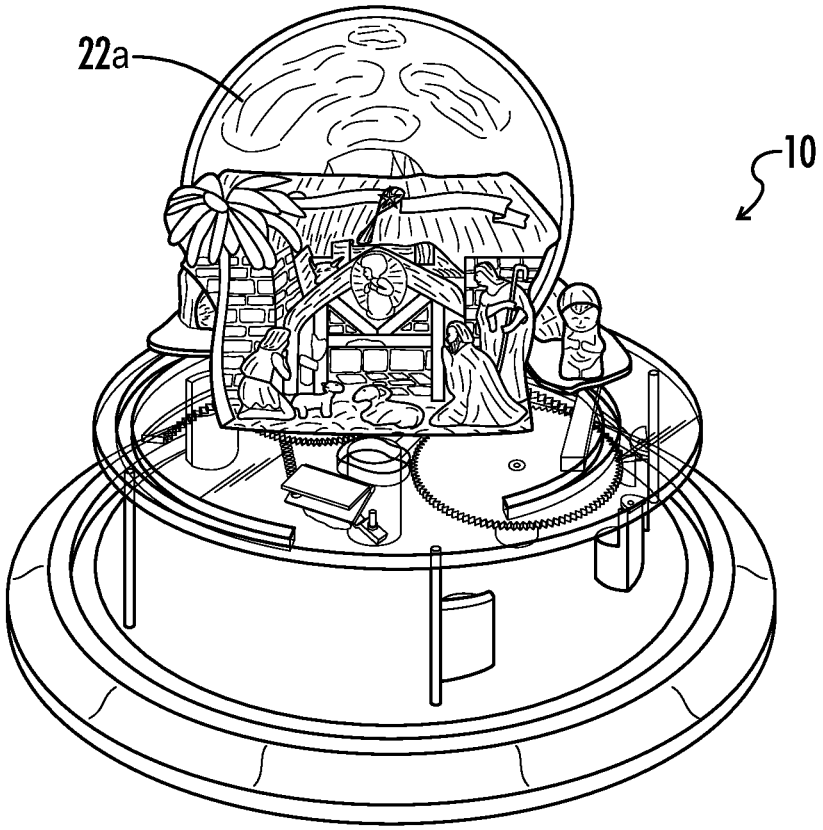
FIG. 2 is a front view of the clock of FIG. 1, with the cover removed and the first and second display assemblies in a first (starting) position.

Referring now to FIG. 2, the clock assembly 10 as described above with respect to FIG. 1 is represented with the cover 16 removed and the second display portion 22 positioned so as to display the first background image 22*a*. The first and second display assemblies 24, 28 are further represented in their respective first (starting) positions along their respecting first and second grooves 26, 30 in the second tier 16 of the base 11.

Figure 3:
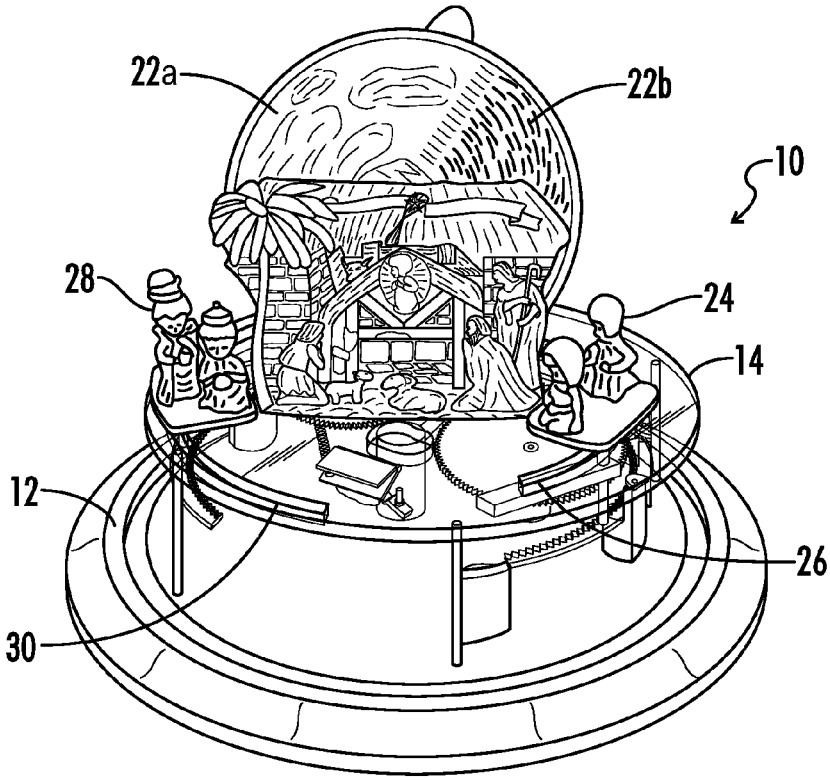
FIG. 3 is a front view of the clock of FIG. 2, with the first and second display assemblies between first and second positions.

Referring now to FIG. 3, the clock assembly 10 as described above with respect to FIG. 1 is represented with the cover 16 removed and the second display portion 22 positioned so as to display the second background image 22*b*. The first and second display assemblies 24, 28 are further represented as having been driven to an intermediate position between their respective first (starting) and second (ending) positions along their respecting first and second grooves 26, 30 in the second tier 16 of the base 11. The third display assembly remains in a first position with the associated display portion out of sight between the first and second tiers 12, 14.

Figure 4:
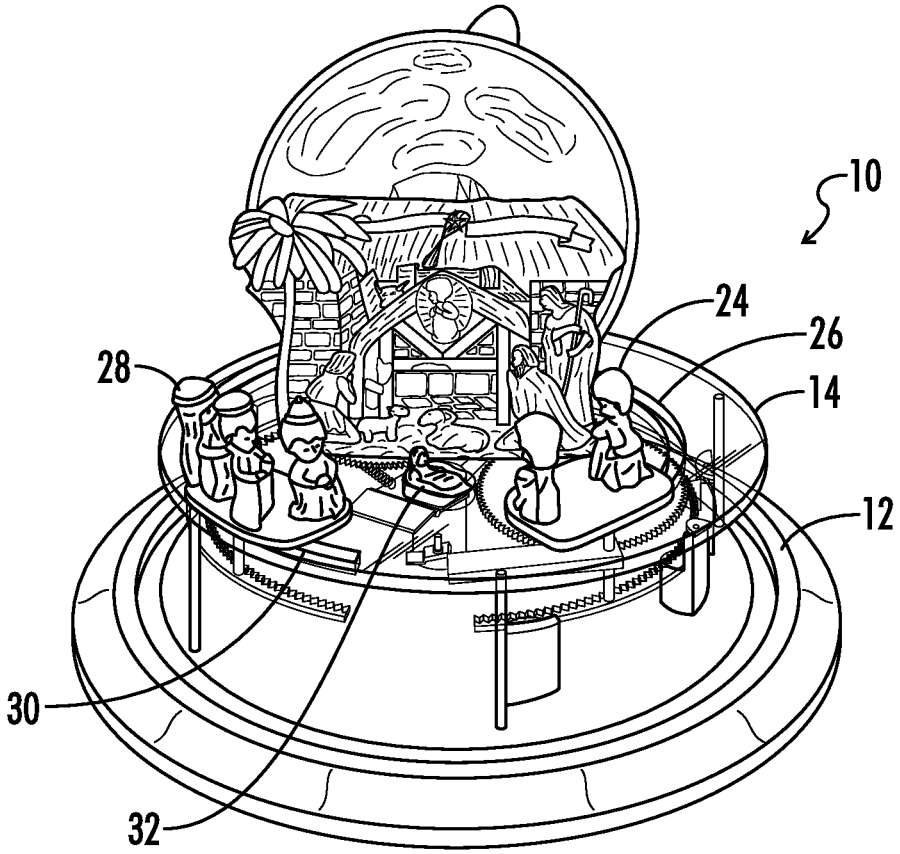
FIG. 4 is a front view of the clock of FIG. 2, with the first display assembly in a second (final) position.

Referring now to FIG. 4, the clock assembly 10 as described above with respect to FIG. 1 is represented with the cover 16 removed. The first display assembly 24 is represented as having been driven to its second (ending) position along the first groove 26 in the second tier 16 of the base 11. In the embodiment wherein the theme of the clock assembly 10 is Christmas, and wherein the first display assembly 24 includes the Holy Family, the ending position would be predetermined at or about Christmas morning. The second display assembly 28 is represented as having been driven to another intermediate position between its first (starting) and second (ending) positions along the second groove 30 in the second tier 16 of the base 11. The third display assembly 32 is now represented in a second position relative to a first (e.g., top) face of the second tier 14, having been moved from the first position through the aperture 32 in the second tier 14 in response to a trigger such as for example by the first display assembly 24 reaching its ending position.

Figure 5:
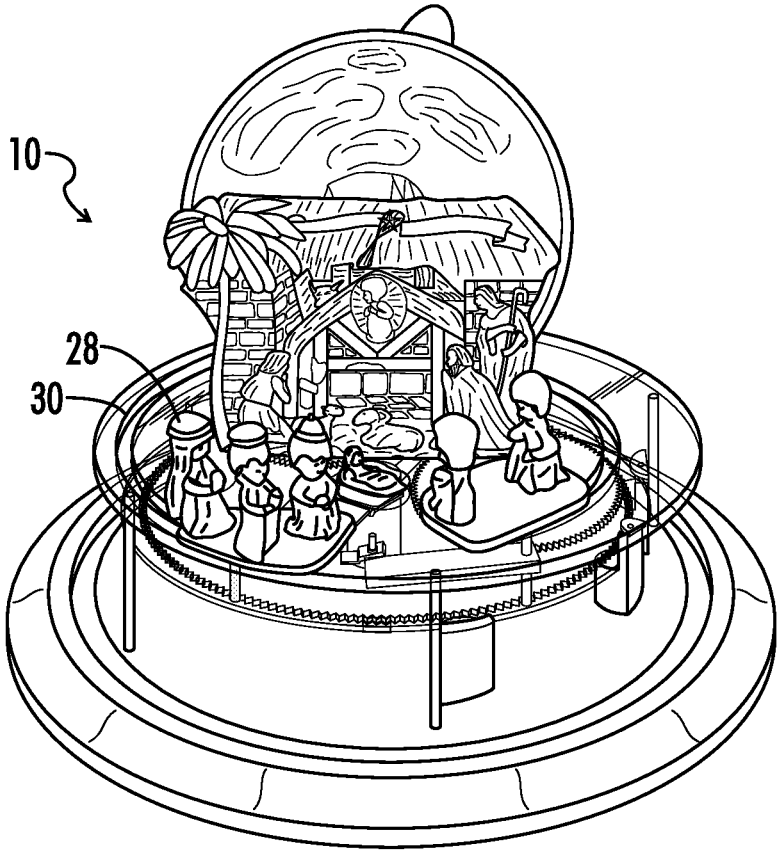
FIG. 5 is a front view of the clock of FIG. 2, with the second display assembly in a second (final) position.

Referring now to FIG. 5, the clock assembly 10 as described above with respect to FIG. 1 is again represented with the cover 16 removed. The first display assembly 24 is still represented as having been driven to its second (ending) position along the first groove 26 in the second tier 16 of the base 11. The second display assembly 28 is now represented as having been driven to its second (ending) position along the second groove 30 in the second tier 16 of the base 11. In the embodiment wherein the theme of the clock assembly 10 is Christmas, and wherein the second display assembly 24 includes the three Kings, the ending position may for example be predetermined at or about the Epiphany.

Figure 6:
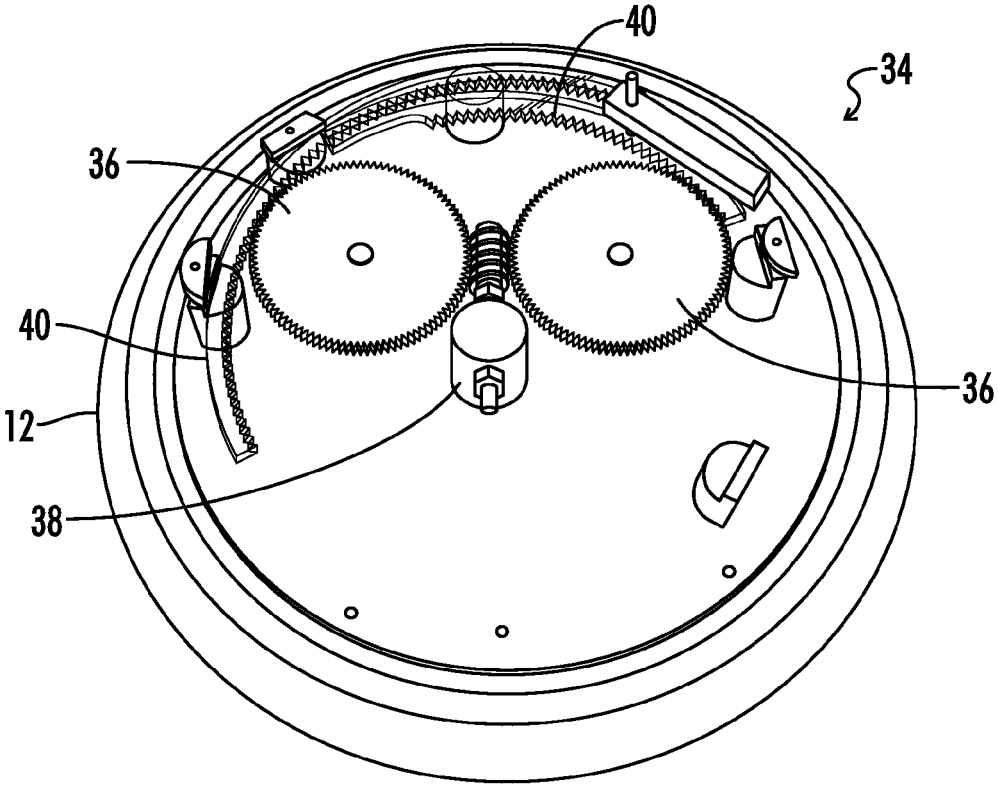
FIG. 6 is a top view of a first platform of the base of the clock of FIG. 1, with gear assembly.

Referring now to FIG. 6, in an embodiment the gear assembly 34 is coupled to the first tier 12 and includes one or more gear drives 36, a worm drive 38 arranged to drive the gear drives, and Plexiglas gear riders 40 coupled to the gear drives and onto which the first and second display assemblies 24, 28 may be coupled for driving along the grooves of the second tier.

Alternative embodiments of a gear assembly 34 effective to drive the first and second display assemblies, or alternative positions or configurations of an equivalent gear assembly 34, are within the scope of the present invention and would be understood by one of skill in the art. For example, with reference to FIGS. 10 and 11, one alternative may include a first disk 42 which is vertically oriented (perpendicular) with respect to the first tier 12 of the clock 10 and two slotted gears 44*a*, 44*b* which are horizontally oriented (parallel) with respect to the first tier 12 of the clock 10 and are coupled in parallel with each other via a belt (e.g., rubber band or the like). In the example shown, a motor drives the vertical disk 42 and the horizontal gears 44*a*, 44*b* such that the worm gear drives the gear arms at a predetermined speed and further such that the gear comes to a stop at a predetermined end of travel, i.e., when the attached assemblies (figurines) 26, 28 reach their final stopping positions. An adjustment member 46 such as a rod which perhaps a thumbwheel or the equivalent may further be provided for the purpose of easily resetting the assemblies 26, 28 from their final positions to their starting positions.

Figure 7:
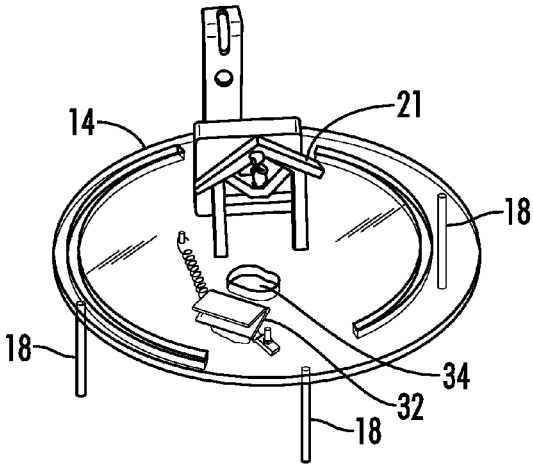
FIG. 7 is a top view of a second platform of the base of the clock of FIG. 1, with the third assembly in a first position.

Referring now to FIG. 7, the second tier 14 of the base is represented with the first display portion 21 of the background clock assembly 20 coupled to the second tier 14, the aperture 34 associated with the third display assembly 32, and the third display assembly 32 being spring-loaded in its first position wherein the displayed feature (e.g., the representation of baby Jesus) is beneath the second tier 14 and out of sight.

Figure 8:
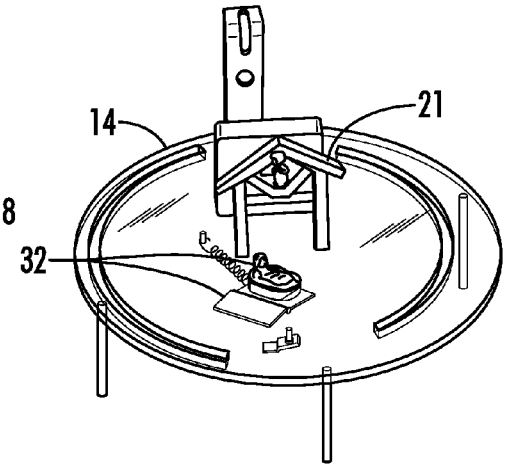
FIG. 8 is a top view of the second platform of the base of the clock of FIG. 1, with the third assembly in a second position.

Referring now to FIG. 8, the second tier 14 of the base is represented with the first display portion 21 of the background clock assembly 20 coupled to the second tier 14, and the third display assembly 32 having been moved to its second position wherein the displayed feature (e.g., the representation of baby Jesus) is now in view.

Figure 9:
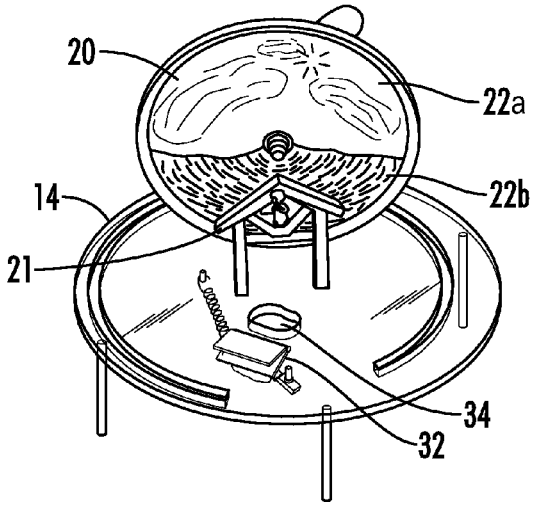
FIG. 9 is a top view of the second platform of the base of the clock of FIG. 1, with the background clock assembly attached.

Referring now to FIG. 9, the second tier 14 of the base is represented with the first display portion 21 of the background clock assembly 20 coupled to the second tier 14, the second display portion 22 of the background clock assembly 20 mounted in place and rotated to the first background display 22*a* being on top (in a displayed position) while the second background display 22*b* is on bottom (in a hidden position when the clock is fully assembled), the aperture 34 associated with the third display assembly 32, and the third display assembly 32 being spring-loaded in its first position wherein the displayed feature (e.g., the representation of baby Jesus) is beneath the second tier 14 and out of sight.

Figure 10:
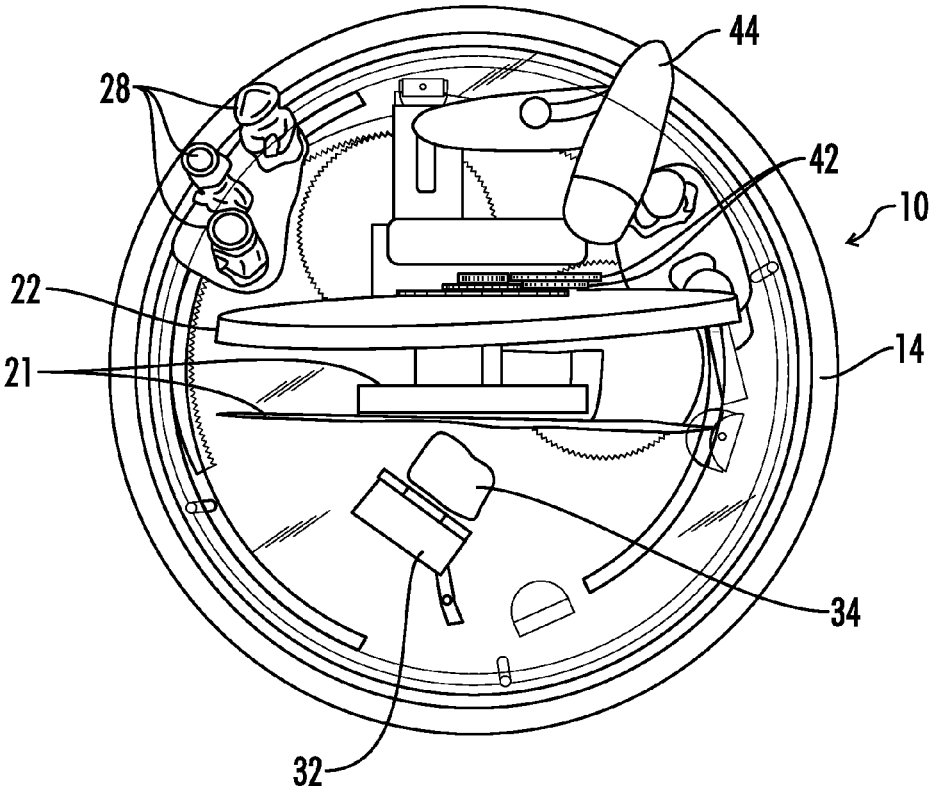
FIG. 10 is a top view of the assembled clock of FIG. 1.
Figure 11:
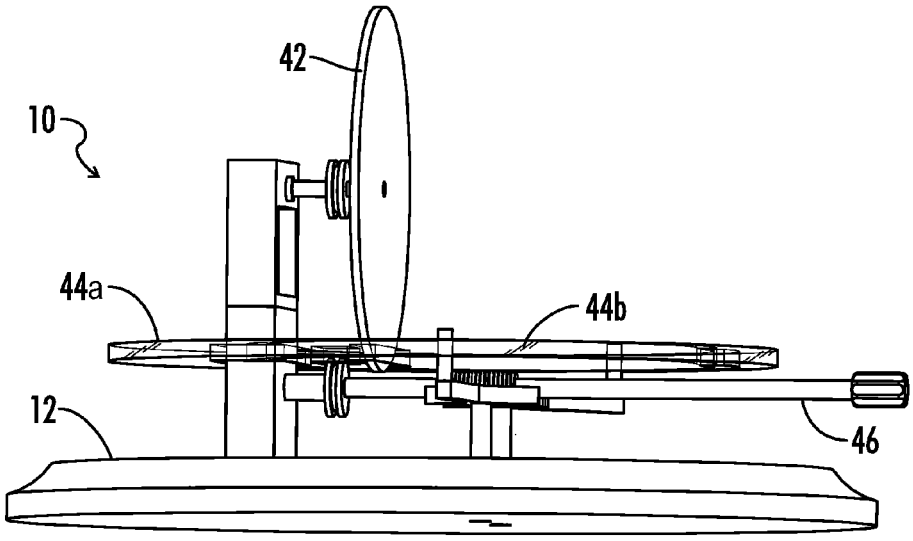
FIG. 11 is a side view of the first platform of the base of the clock of FIG. 1, with an alternative embodiment for the gear assembly.
Figure 12:
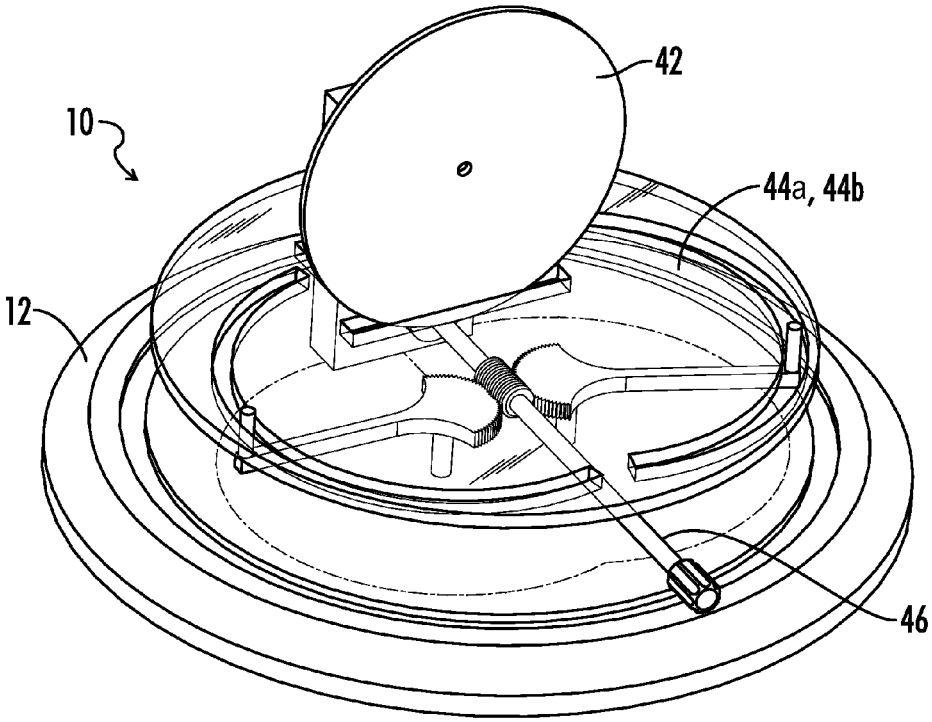
FIG. 12 is an isometric view of the gear assembly of FIG. 11.

Referring now to FIG. 10, in an embodiment as shown a light source 44 of the background clock assembly 20 and one or more gears 42 of the background clock assembly 20 as needed to drive the second display portion 22 as described above are visually represented.

The previous detailed description has been provided for the purposes of illustration and description. Thus, although there have been described particular embodiments of the present invention of a new and useful "Christmas Themed Mechanical Clock," it is not intended that such references be construed as limitations upon the scope of this invention except as set forth in the following claims.

What is claimed is:

1. A Christmas-themed mechanical clock comprising:

a base having a first substantially planar platform and a second substantially planar platform spaced apart from and positioned in parallel with the first platform, the second platform further comprising first and second grooves;

at least one gear drive positioned between the first and second platforms;

a first nativity character assembly coupled to one of the at least one gear drives and driven by said gear drive between first and second positions along the first groove for a first predetermined period of time;

a second nativity character assembly coupled to one of the at least one gear drives and driven by said gear drive between first and second positions along the second groove for a second predetermined period of time;

a twenty-four hour background clock assembly coupled to the second platform, at least a portion of which is effective to rotate in accordance with first and second twelve hour time periods to display first and second background images, respectively.

* * * * *